US006763679B1

(12) United States Patent
Leitch et al.

(10) Patent No.: US 6,763,679 B1
(45) Date of Patent: Jul. 20, 2004

(54) STANDOFF FOR DESICCANT IN CONDENSER RESERVOIR OF AUTOMOTIVE AIR CONDITIONING SYSTEM

(75) Inventors: Frank Joseph Leitch, North Tonawanda, NY (US); Ben V. Koss, Amherst, NY (US); Robert Charles Gmerek, Burt, NY (US); Michael Czajkowski, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/405,015

(22) Filed: Apr. 1, 2003

(51) Int. Cl.[7] ..... F25B 43/00
(52) U.S. Cl. ..... 62/474; 62/509
(58) Field of Search ..... 62/473, 474, 476, 62/509

(56) References Cited

U.S. PATENT DOCUMENTS 4,354,362 A 10/1982 Schumacher et al. ..... 62/474
5,159,821 A 11/1992 Nakamura ..... 62/509
5,537,839 A 7/1996 Burk et al. ..... 62/474
5,666,791 A * 9/1997 Burk ..... 62/474
6,170,287 B1 1/2001 Leitch et al. ..... 62/474

FOREIGN PATENT DOCUMENTS

EP 1079186 A1 * 2/2001

* cited by examiner

*Primary Examiner*—Melvin Jones
(74) *Attorney, Agent, or Firm*—Patrick M. Griffin

(57) ABSTRACT

A canister is attached to a header tank and includes an upper inlet and a lower outlet. Before end cap is brazed to close the bottom of canister, a tube of desiccant material is installed into the canister by a standoff. The standoff includes a disk shaped base and narrow central post which is comparable in length to the height of the inlet above the lower end cap. This is followed by inserting a spur of a higher melting temperature into the canister into a position and extending radially from the post and into an interference fit with the interior wall of the canister that is tighter than the interference fit between the base and the canister.

22 Claims, 3 Drawing Sheets

STANDOFF FOR DESICCANT IN CONDENSER RESERVOIR OF AUTOMOTIVE AIR CONDITIONING SYSTEM

TECHNICAL FIELD

This invention relates to air conditioning systems in general, and specifically to an improved desiccant installation for a condenser having an attached receiver.

BACKGROUND OF THE INVENTION

Automotive air conditioning systems typically include either an accumulator canister or a receiver canister that serve as a refrigerant reservoir. An accumulator is located just before the compressor, and allows only (or substantially only) refrigerant vapor to be drawn off of the top before compression, with liquid settling at the bottom. Receiver canisters are located just after the condenser, and are intend to allow only (or substantially only) liquid refrigerant to be drawn off the bottom for the refrigerant expansion valve. A canister of either type also provides a convenient location for a container of desiccant material, usually a bag or pouch of mesh material, which absorbs water vapor from the liquid refrigerant reservoir. Either an accumulator or a receiver usually has ample room within it for the desiccant, and some kind of pre-existing piping arrangement within it from which the desiccant bag can be conveniently suspended. The desiccant works better if suspended within, rather than resting free on the bottom of the canister, and is also less subject to damage in the event that a bottom closure is later welded to the canister. A typical example of such an arrangement may be seen in U.S. Pat. No. 4,354,362, where an internal pipe provides a practical suspension post for a desiccant container.

A relatively recent trend is the attached or so-called "integral" receiver, into which a reservoir canister is incorporated structurally onto, on into, the return header tank of a so-called cross flow condenser design. A cross flow or "headered" condenser typically has a main pass, within which gas condenses to liquid, and a sub cooling section, within which liquid refrigerant is further cooled. An example may be seen in U.S. Pat. No. 5,537,839. The reservoir runs along the side of the return tank, and two openings or short pipes near the base of the return tank connect the main pass condenser tubes to the reservoir canister. The two openings are separate or discrete, so that all condensed refrigerant entering the return tank from the main pass is forced to flow through the upper opening and into the reservoir canister, where it forms a rising or falling reserve liquid column (depending on conditions). From the reservoir canister, liquid refrigerant can flow into the discrete lower opening and into the sub cooling section, and ultimately to the expansion valve. Generally, and preferably, the reservoir canister or tank section is no more than an empty vessel, with any internal structure suitable for suspending a desiccant cylinder or pouch. One exception may be seen in U.S. Pat. No. 5,159,821. There, refrigerant is forced centrally up into the reservoir canister in a fountain like central pipe, which also provides a convenient suspension pole for the desiccant cylinder. However, this is an undesirably complex and expensive structure.

More typically, the desiccant would simply rest where gravity would take it anyway, on the inside of the base of the reservoir canister, and this is the situation disclosed in the above mentioned U.S. Pat. No. 5,537,839. This puts the desiccant container both in a position where it could be damaged by welding or brazing on a bottom closure, and in a position where it is axially coextensive with, and could clog or block, the discrete openings between the reservoir canister and the return manifold. The patent recognizes this issue by providing a separate bottom threaded plug for installing the desiccant container. There is also provided an additional internal cage like structure to confine the desiccant away from the openings. That same structure retains the desiccant so that it is in line with the openings, and therefore at least theoretically capable of blocking them. Furthermore, the cage like structure represents a potential threat to the structural integrity of the desiccant container, which is generally a cloth or plastic open mesh, especially when subjected to vibration and bouncing in operation. Both the threaded plug and the retention cage also require additional cost and manufacturing steps.

Yet a further improvement is set forth in U.S. Pat. No. 6,170,287, assigned to the assignee of the subject invention and including some, but not all, of the inventors named herein. This patent discloses a simple cylindrical reservoir canister alongside the return tank. The main pass empties into the return header, which then empties into the reservoir canister through a discrete inlet just above the separator. From the reservoir canister, the liquid refrigerant empties back into the return tank through an outlet and then into the sub cooler section. There is no inner structure within the reservoir canister beyond the smooth inner wall, and it is preferably enclosed at top and bottom by a simple cap that is brazed or welded in place, giving a simple and reliable seal. A cylindrical, open mesh container of desiccant material has a diameter that gives it a small radial clearance from the inner wall of the reservoir canister, and an axial length which, if it were allowed to rest on the bottom of the reservoir canister, would put it in line with both the inlet and outlet, and liable to block free flow through them.

This is prevented under the invention of the '287 patent by a standoff structure that consists of a narrow, centrally located bottom post and an upper, disk shaped base. The post is longer than the height of the inlet above the bottom end cap of the reservoir canister, and the base has an outer diameter that makes a tight interference fit with the inner wall of the reservoir canister. Therefore, the standoff structure can be used to insert the desiccant into the reservoir canister before the bottom end cap is sealed in place. The desiccant can be inserted past and beyond the inlet and outlet openings, where it will remain, at least temporarily, until after the bottom cap is welded in place, safe from heat damage. In later operation, the interference fit will help prevent vibration and damage of the desiccant tube within the canister, and even if the desiccant should sink downwards, the desiccant itself will never rest on the bottom of the canister, or block the inlet and outlet, because of the dimensions of the post. Cut outs are provided in the edge of the disk to allow liquid refrigerant to freely flow up or down past the disk.

The one-piece standoff prevents the desiccant bag from blocking the communication ports and is made of a material that allows ultrasonic welding of the polyester bag containing the desiccant. As alluded to above, the interference fit between the standoff and the interior wall of the cylindrical canister keeps the bag away from the heat generated by brazing or welding the end cap to the end of the canister. It is important that this interference fit require a high insertion force and not be degraded to the extent that desiccant bag can move within the canister after the end caps are brazed or welded in place. Such undesirable movement of the desiccant bag results in a rattle. The material selected for the standoff must meet the temperature criteria for ultrasonic welding to the polyester bag for the desiccant bag while at the same time resisting degradation from the welding or brazing of the end cap to the canister. The material of the standoff must balance between the welding to the desiccant bag and the heat deflection from welding or brazing the end cap to close the canister. A poor weld of the canister bag to the standoff can result in the bag detaching from the standoff in assembly and degradation of the interference fit between the standoff and the canister from excessive heat can result in rattle of the desiccant bag within the canister.

SUMMARY OF THE INVENTION

An improved standoff for desiccant in a condenser reservoir of automotive air conditioning system is provided by the subject invention.

In accordance with the subject invention, a desiccant material container is inserted within the interior wall of a canister having an inlet and an outlet along with a standoff. Thereafter, a spur is inserted into the canister and along the standoff into a position supported on and extending radially from the standoff and into an interference fit with the interior wall of the canister.

The spur may be of a material different than the material of the standoff whereby the spur withstands a higher temperature than the standoff. Accordingly, the subject invention facilitates a maximum and secure bond between the standoff and the desiccant bag while at the same time the spur maintains the integrity of the interference fit between the standoff and the canister after welding or brazing of the end cap to the canister to minimize rattle after prolonged use. This can be accomplished while at the same time reducing the insertion force required to insert the standoff and desiccant bag into the canister. In other words, the interference fit need not be over tight to allow for degradation from the heat of securing the end cap to the canister.

BRIEF DESCRIPTION OF THE DRAWINGS

These and other features of the invention will appear from the following written description, and from the drawings, in which.

DESCRIPTION OF THE PREFERRED EMBODIMENT

Figure 1:
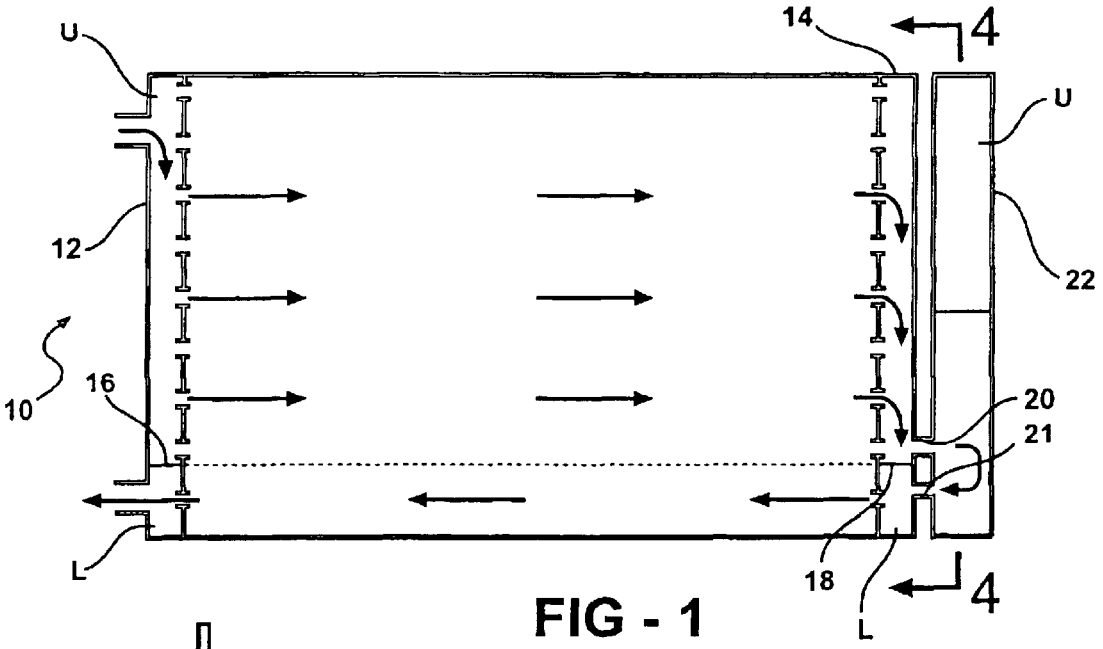
FIG. 1 is a schematic view of the type of condenser in which the invention is installed.

Referring first to FIG. 1, a condenser 10 of the cross flow, headered type has an inlet/outlet header tank on one side, and a return header tank on the other, each of which is divided into discrete upper (U) and lower (L) sections by separators and respectively. Heated, compressed refrigerant vapor enters the upper section (U) of header tank, above separator, and flows across and through the flow tubes in the main pass section (not illustrated in detail). In the main pass, refrigerant is condensed to liquid form and flows into the upper section (L) of return tank, above the separator. From there, all liquid refrigerant is forced, by the separator, to flow through an upper inlet and into an attached reservoir canister, where it backs up into a reserve column of varying height. From the reserve column, liquid refrigerant can flow down and through a lower outlet, into lower section (L) of return tank and ultimately into a sub cooler section of condenser, comprised of those flow tubes located below the two separators. In the sub cooler section, liquid refrigerant is further cooled, below the temperature necessary to simply condense it, and flows finally back into the lower section (L) of header tank. No desiccant structure is illustrated within the interior wall of the canister in FIG. 1, but that is described next.

Figure 2:
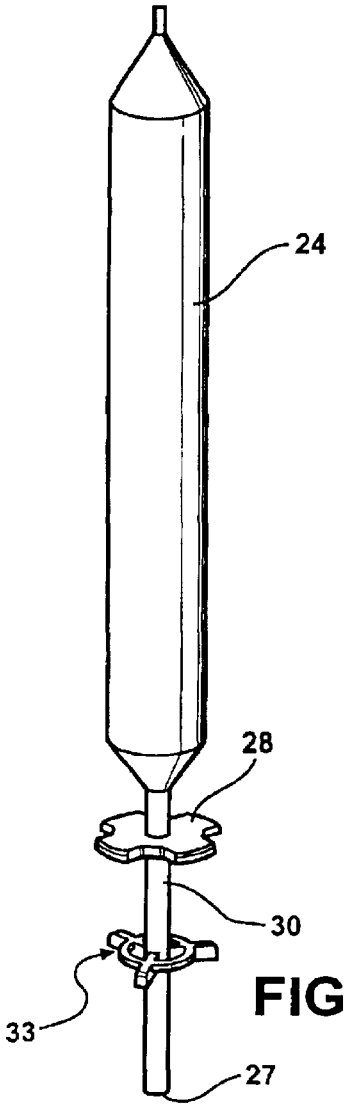
FIG. 2 is a perspective view of a desiccant tube and standoff.
Figure 3:
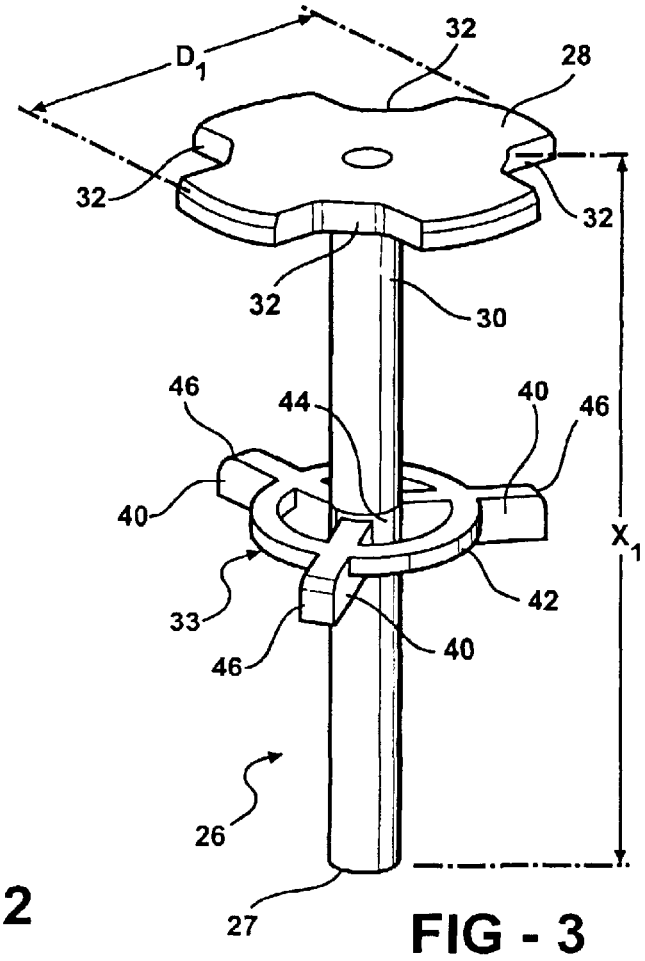
FIG. 3 is a perspective view of just the standoff structure.

Referring next to FIG. 2, a desiccant container comprises a simple, elongated cylindrical tube of mesh material, which has an open weave with a fill of conventional granular desiccant material contained within. Tube is heat-sealed or otherwise closed at the top, and, at the bottom, is preferably fixed to a standoff, generally shown. The standoff is disposed within the interior wall of the canister and includes a central post that is substantially narrower than the cross section of the space defined by the interior wall of the canister. A disk shaped base is disposed on the upper end of the solid central post and is in a frictional interference fit with the interior wall of the canister.

The post extends from the top thereof through an axial length X1 to a lower end, the axial length X1 being as long as the axial height of inlet above the lower end closure for maintaining the desiccant material container disposed above the inlet and the outlet while leaving the inlet and the outlet unblocked by virtue of the length and width of the post.

The base is four lobed, with a circular outer edge of diameter of D1, broken into four equal arcs by four cut outs. In the embodiment disclosed, the desiccant tube is preferably fixed centrally to the upper surface of base by glue, sonic welding or other technique to create a unit that can be handled during installation as, and operate later as, a single component. The standoff is preferably made of polyester for easy welding to the polyester desiccant bag or tube. The standoff could also be made of nylon or any other material suitable for a strong adhesion to the bag.

A spur is supported on and extends radially from the post and makes an interference fit with the interior wall of the canister. The spur is of a material different than the material of the standoff. More specifically, the material of the spur is made of an organic polymeric (plastic) material that has a higher melting temperature than the organic polymeric (plastic) material of which the standoff is made, as by injection molding. The material of the spur is a high melting plastic that has a heat deflection temperature in excess of 400° F. Both materials will be refrigerant resistant. The disk shaped base is integral with and supported on the upper end of the post and the spur is spaced axially along the post below the base. The base has a frictional interference fit with the interior wall of the canister.

The spur includes a plurality of radially extending spokes and a ring interconnecting the spokes. The post defines an annular groove and the spokes have inner ends disposed in the groove to define a mechanical connection between the spur and the post. The groove could be in the form of a plurality of annularly spaced notches instead of a groove continuously extending about the post. In other words, dividing the groove into discrete notches to receive the ends of the spokes results in the same mechanical connection. The spokes have outer ends that are in frictional engagement with the interior wall of the canister. However, the frictional interference fit between the base and the interior wall is less than the interference fit between the spokes of the spur and the interior wall.

The ring is spaced radially from both of the ends of the spokes whereby it is disposed approximately midway along the length of the spokes. The spokes each have a relieved corner for facilitating insertion of the spur into the canister.

Figure 4:
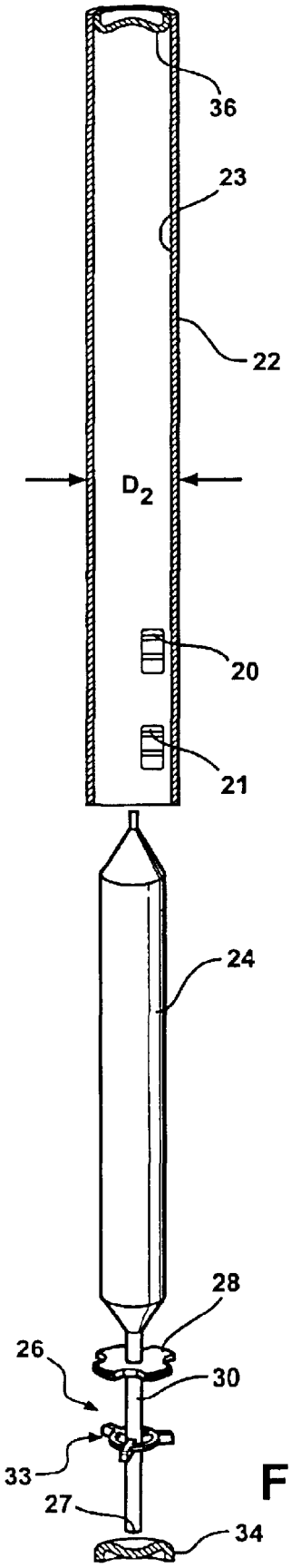
FIG. 4 an exploded view showing a cross section of the reservoir canister with the desiccant tube-standoff aligned therewith.
Figure 5:
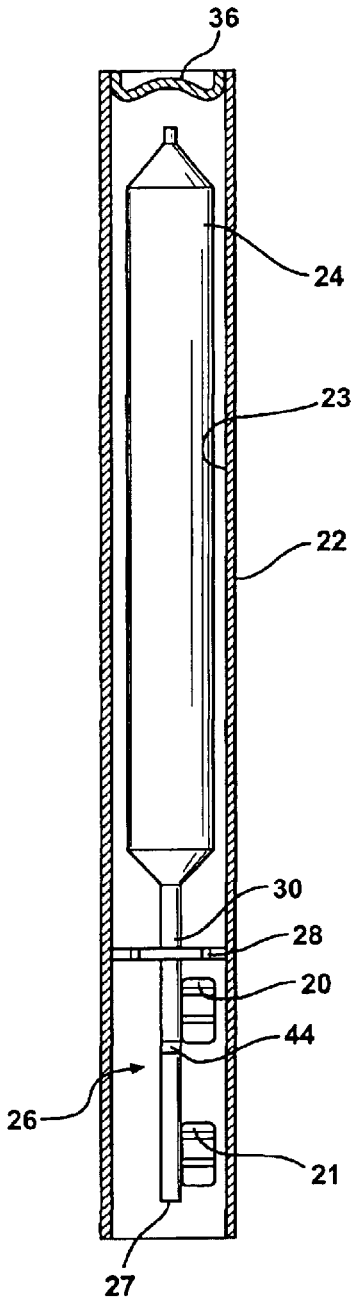
FIG. 5 is a view like FIG. 4 showing the standoff inserted prior to insertion of the spur and canister closure.

Referring to FIG. 4, the reservoir canister is shown prior to the insertion of the spur and having its open lower end closed by an end cap. An upper end cap has already closed the upper end. As disclosed, at this point in the manufacture, the entire condenser would have been run through the braze oven, and be complete, but for the installation of the desiccant containing tube and the lower end cap. However, it could be that neither end cap is in place, or, the lower end cap could be in place, but not the upper end cap. The invention will accommodate any of those possible scenarios. Next, as shown in FIG. 5, the tube is inserted into the interior wall of the canister, through the open lower end, by pushing up on the standoff. This could be done easily by hand, or automated, since the post and base are easily grabbed and manipulated, and are not subject to damage, as the material of the tube would be. The tube standoff unit is pushed in until the arcuate edges of base tightly engage the interior wall of canister with an interference fit. The interior wall of canister has a diameter D2 that is sufficiently smaller than diameter D1 to assure that snug frictional interference fit. The unit is pushed to the point shown in FIG. 5, where the end of the tube is clear of the upper end cap, and the bottom of post is clear of the bottom of canister. It will remain in that position, at least temporarily, by virtue of the interference fit. This interference fit between the base and the canister need only be sufficient to hold the post in this pre-assembled position until the tighter interference fit of the spur is attained. This facilitates a lower insertion force than in previous assemblies.

Figure 8:
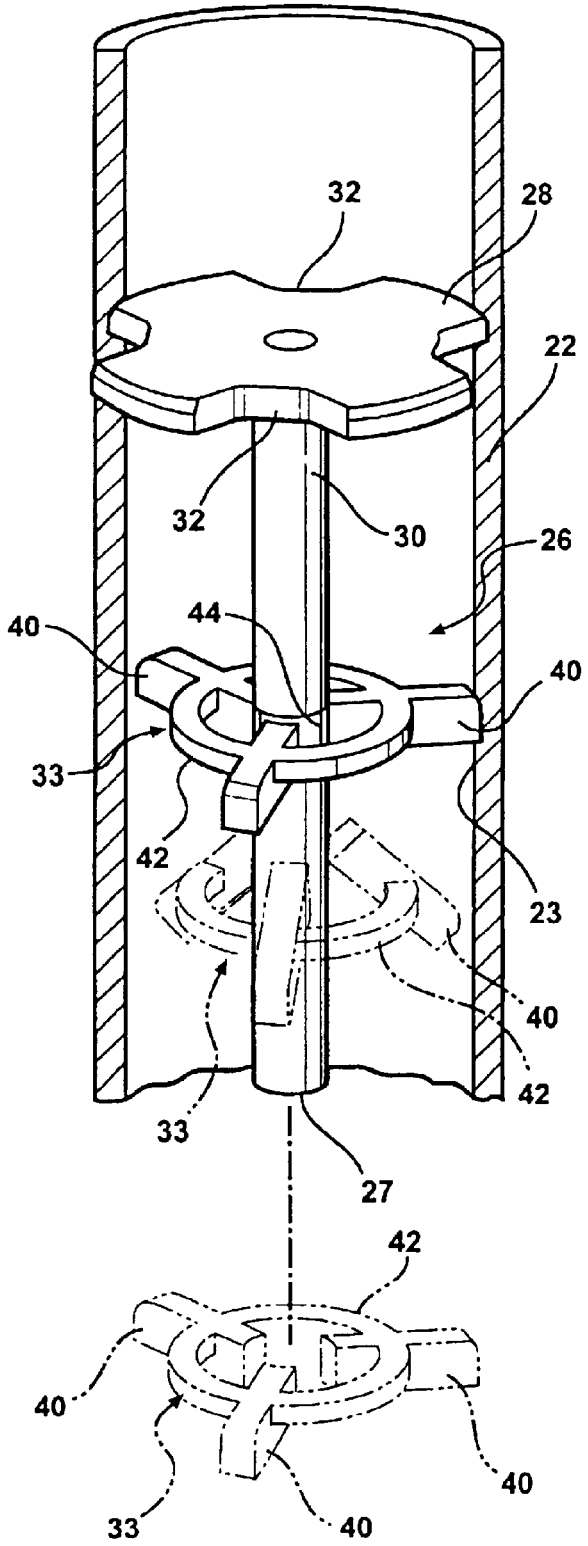
FIG. 8 shows the spur being moved into mechanical connection with the post of the standoff.

As best illustrated in FIG. 8, the spur is molded in a flat configuration as shown in phantom at the bottom of FIG. 8 with the ring spaced sufficiently from the inner ends of the spokes to allow the spokes to rotate in a radial plane about the ring to an open position, as shown in phantom in the middle of FIG. 8. While the post is being held against movement, as it is in the inserted position of FIG. 5, the spur, while in the open position, is moved into the open bottom of the canister and along the post. A tool may be utilized to insert the spur that grips the post and reacts against the inner ends of the spokes to push the spur open and into the canister until the spokes reach the groove. The spur is inserted into the canister as the inner ends of the spokes slide along the post and reach the groove whereupon the spokes are released with the inner ends thereof disposed in the groove to form a mechanical connection between the spur and the post. In other words, when the spokes are released, the inherent resiliency of the spur returns it to the flat configuration thereby urging or biasing the inner ends of the spokes into the groove.

Figure 6:
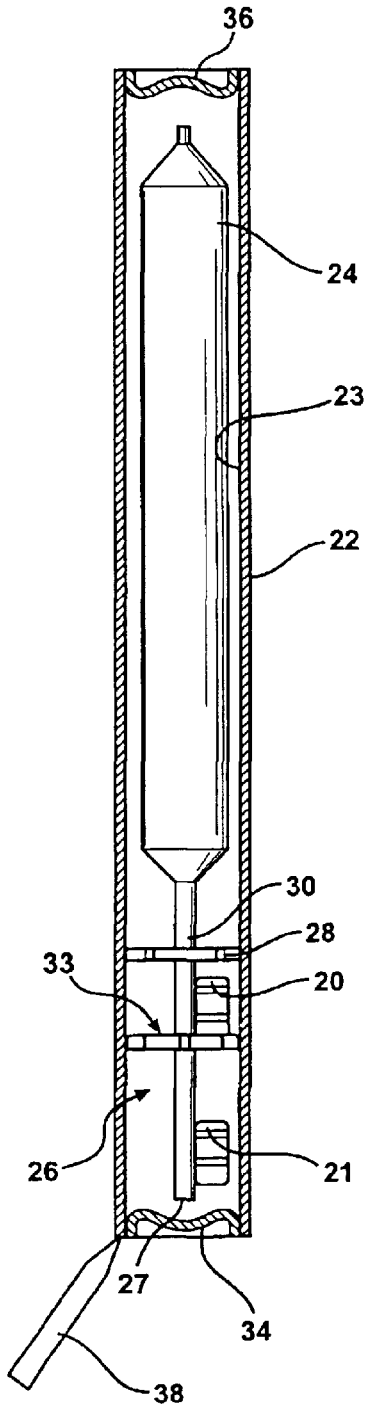
FIG. 6 is a view like FIG. 5, showing the canister closure welding, process with the desiccant container held in a protected position.

Referring next to FIG. 6, once the tube, standoff and spur have been positioned in the canister, the bottom end cap is welded into place by welding tool. In the location shown, the tube, and the bottom of the post, are well clear of the heat produced by the bottom closure process. The bottom cap provides a very inexpensive and secure closure and seal, as compared to a threaded plug, or other closure that is installed without heat.

Figure 7:
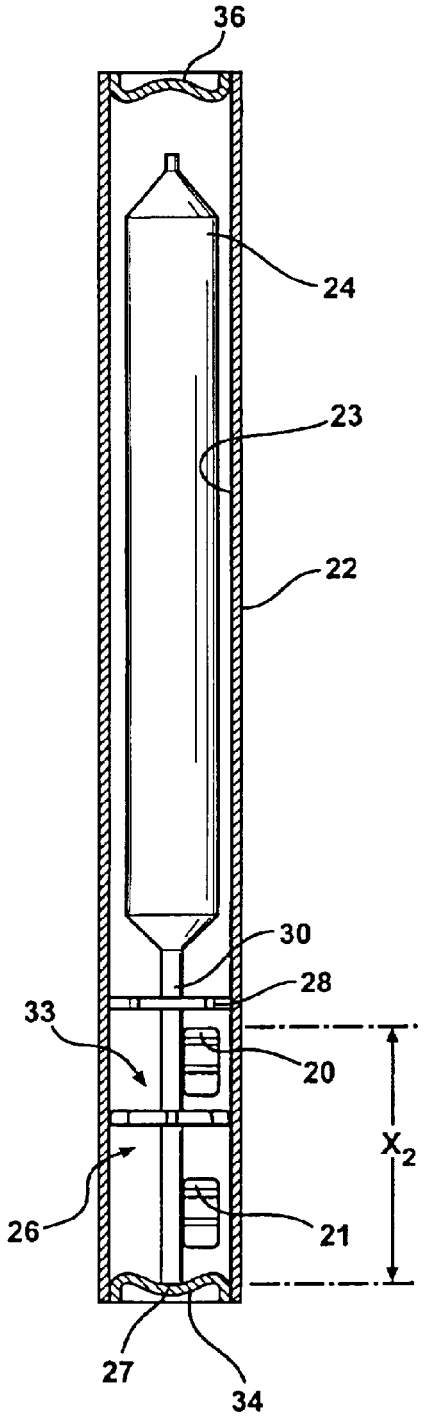
FIG. 7 shows the location of the unit within the reservoir canister after an equilibrium position has been reached during operation.

Although the stronger interference fit between the spur 33 and the canister should prevent rattle, during operation, the spur may slide downwardly in the canister to allow the tube and standoff to sink down under the force of gravity and vibration until the bottom end of the post rests upon the bottom end cap, as shown in FIG. 7. However, the height of the upper inlet above the bottom end cap, indicated at X2, is comparable to or less than the length X1 of the post. The post, then, is of sufficient axial length to keep the tube, supported on base, above and clear of the inlet and outlet at all times during operation, so that flow in or out will not be impeded. Once flow has entered the canister below the base, it can flow freely up (or back down) through the spokes of the spur and the cut outs of the base, and around (and through) the mesh material of the tube. In addition, the surface of the tube is kept away from the sharp edges of the openings, where it could be damaged, and is exposed only to the smooth, upper inner surface of canister, where it is far less subject to damage. Furthermore, fixing the bottom of tube to the base helps to keep the tube, which has some inherent stiffness, radially centered and away from the wall of canister, preserving a radial clearance for refrigerant flow. So doing also prevents tube from bouncing axially up and down within canister in operation.

Variations in the disclosed embodiment could be made. The base need not be directly attached to the bottom of tube, nor the post directly attached to base, and the two would still act as a locator and standoff. The standoff function alone could be provided, most simply, just by a post of sufficient length (long enough to keep the tube off of the bottom of the canister). A disk shaped structure like base allows the bottom of tube to rest on post without damage, while still being open to refrigerant flow past the base. That disk like structure could be integral to, or even a part of the bottom of, tube, however, and could be open to refrigerant flow by virtue of being a meshed structure or the like, instead of having the cut outs. Having a discrete structure, like base, anchored to the bottom of tube, rather than just resting freely on top of it, provides the additional advantages noted above of keeping the tube axially and radially located, in addition to just keeping it off of and away from the bottom cap and clear of the ports.

The invention therefore provides a method of disposing a desiccant material container within the interior wall of a canister having an inlet and an outlet. The method includes the steps of inserting a desiccant material container followed by a standoff into the interior wall of the canister, as illustrated in FIG. 5. As shown in FIG. 8, this is followed by inserting a spur into the canister and along the standoff into a position supported on and extending radially from the standoff and into an interference fit with the interior wall of the canister.

As alluded to above, the spur is preferably of a material different than the material of the standoff. More specifically, the spur is made of an organic polymeric material that has a higher melting temperature than the organic polymeric material of the standoff.

After the standoff and desiccant container are in the canister, the spur is inserted into a position spaced axially along the post below the base and into a frictional interference fit with the interior wall of the canister. More specifically, the frictional interference.fit between the base and the interior wall is formed to be less than the interference fit between the spur and the interior wall.

As illustrated in FIG. 8, the insertion of the spur is further defined as rotating the spokes about the ring into a cone and moving the inner ends of the spokes along the post and rotating the outer ends of the spokes about the inner ends to mechanically engage the inner ends with the post as the spokes are moved into a radial plane. Inserting the inner ends of the spokes into a groove or the like establishes the mechanical connection with the post. As the inner ends of the spokes engage the groove, the outer ends of the spokes continue to move along the post about the inner ends thereof until the spur again becomes flat and the outer ends of the spokes are in the frictional engagement with the interior wall.

What is claimed is:

1. A condenser assembly comprising;

a generally vertically oriented return header tank, a generally cylindrical reservoir canister attached beside said return header tank and having an inlet into said return header tank and an outlet into said return tank lower section (L), said canister having an interior wall and including a lower end closure, a desiccant material container disposed within said interior wall of said canister, a standoff disposed within said interior wall of said canister and includes a central post that is substantially narrower than the cross section of the space defined by said interior wall of canister and as long as the axial height of inlet above the lower end closure for maintaining the desiccant material container disposed above said inlet and said outlet while leaving said inlet and said outlet unblocked by virtue of the length and width of said post, a spur supported on and extending radially from said post and making an interference fit with the interior wall of said canister, said spur being of a material different than the material of said standoff.

2. An assembly as set forth in claim 1 wherein said standoff is made of an organic polymeric material and said spur is made of an organic polymeric material that has a higher melting temperature than the organic polymeric material of said standoff.

3. An assembly as set forth in claim 1 wherein said standoff includes a disk shaped base supported on said upper end of said post, said spur being spaced axially along said post below said base and having a frictional interference fit with said interior wall of said canister.

4. An assembly as set forth in claim 3 wherein said base is integral with said post.

5. An assembly as set forth in claim 3 including a frictional interference fit between said base and said interior wall which is less than the interference fit between said spur and said interior wall.

6. An assembly as set forth in claim 5 including a mechanical connection between said spur and said post.

7. An assembly as set forth in claim 6 wherein said spur includes a plurality of radially extending spokes and a ring interconnecting said spokes.

8. An assembly as set forth in claim 7 wherein said post defines an annular groove and said spokes have inner ends disposed in said groove to define said mechanical connection.

9. An assembly as set forth in claim 8 wherein said spokes have outer ends in said frictional engagement with said interior wall.

10. An assembly as set forth in claim 9 wherein said ring is spaced radially from both of said ends of said spokes.

11. An assembly as set forth in claim 10 wherein said spokes each have a relieved corner for facilitating insertion of said spur into said canister.

12. A method of disposing a desiccant material container within the interior wall of a canister having an inlet and an outlet, said method comprising the steps of;

inserting a desiccant material container followed by a standoff into the interior wall of the canister inserting a spur into the canister and along the standoff into a position supported on and extending radially from the standoff and into an interference fit with the interior wall of the canister.

13. A method as set forth in claim 12 further defined as inserting a spur of a material different than the material of the standoff.

14. A method as set forth in claim 12 further defined as inserting a standoff made of an organic polymeric material and inserting a spur made of an organic polymeric material that has a higher melting temperature than the organic polymeric material of the standoff.

15. A method as set forth in claim 12 further defined as inserting a standoff that includes a post and a disk shaped base supported on the upper end of the post to support the desiccant material container, and inserting the spur to a position spaced axially along the post below the base and into a frictional interference fit with the interior wall of the canister.

16. A method as set forth in claim 15 further defined as inserting a standoff with the base being integral with the post.

17. A method as set forth in claim 15 further defined as forming a frictional interference fit between the base and the interior wall which is less than the interference fit between the spur and the interior wall.

18. A method as set forth in claim 17 including establishing a mechanical connection between the spur and the post.

19. A method as set forth in claim 18 including inserting a spur having a plurality of radially extending spokes and a ring interconnecting the spokes.

20. A method as set forth in claim 19 further defined as inserting the inner ends of the spokes into the post to define the mechanical connection.

21. A method as set forth in claim 20 further defined as disposing the outer ends of the spokes in the frictional engagement with the interior wall.

22. A method as set forth in claim 21 wherein the inserting of the spur is further defined as rotating the spokes about the ring into a cone and moving the inner ends of the spokes along the post and rotating the outer ends of the spokes about the inner ends to mechanically engage the inner ends with the post as the spokes are moved into a radial plane.

* * * * *